US005943826A

United States Patent [19]

Totin

[11] Patent Number: 5,943,826

[45] Date of Patent: Aug. 31, 1999

[54] SNOW GUARD

[76] Inventor: Jody J. Totin, 1922 Stratford Rd., Delaware, Ohio 43015

[21] Appl. No.: 09/057,119

[22] Filed: Apr. 8, 1998

Related U.S. Application Data

[63] Continuation-in-part of application No. 08/859,600, May 20, 1997, abandoned.

[51] Int. Cl.[6] ..... E04D 13/10

[52] U.S. Cl. ..... 52/24; 52/698

[58] Field of Search ..... 52/24, 25, 26, 52/698, 712

[56] References Cited

U.S. PATENT DOCUMENTS

| | | | |
|---|---|---|---|
| D. 30,788 | 5/1899 | Clark | 52/24 X |
| 185,137 | 12/1876 | Rogers | 52/24 |
| 390,061 | 9/1888 | Bower | 52/24 X |
| 625,144 | 5/1899 | Clark | 52/24 |
| 654,438 | 7/1900 | Clark | 52/24 |
| 2,349,201 | 5/1944 | Schweda | 52/24 |
| 3,296,750 | 1/1967 | Zaleski | 52/24 |
| 3,388,738 | 6/1968 | Dery | 52/24 X |
| 5,044,130 | 9/1991 | Chiddister | 52/24 |
| 5,165,214 | 11/1992 | Codd | 52/648.1 |
| 5,242,736 | 9/1993 | Van Erden et al. | 52/410 X |
| 5,343,659 | 9/1994 | Zaleski | 52/24 |
| 5,664,374 | 9/1997 | Lee | 52/24 |

FOREIGN PATENT DOCUMENTS

| | | | |
|---|---|---|---|
| 95455 | 11/1983 | European Pat. Off. | 52/24 |
| 4009164 | 9/1991 | Germany | 52/24 |
| 62468 | 5/1940 | Norway | 52/24 |
| 626937 | 12/1981 | Switzerland | 52/24 |
| 671063 | 7/1989 | Switzerland | 52/24 |
| 666147 | 2/1952 | United Kingdom | 52/25 |

*Primary Examiner*—Carl D. Friedman
*Assistant Examiner*—Laura A. Callo
*Attorney, Agent, or Firm*—Christen M. Millard; Kremblas, Foster, Millard & Pollick

[57] ABSTRACT

A snow guard includes a strap made from pressed corrosion resistant metal tubing to resist bending. The strap configurations accommodate different types of roof materials. A head of a sufficiently thick corrosion resistant sheet metal is pressed into a shape to resist the load of snow and ice. The head is soldered or welded to the strap to form a rigid joint.

19 Claims, 3 Drawing Sheets

SNOW GUARD

CROSS-REFERENCES TO RELATED APPLICATIONS

This is a continuation-in-part of application Ser. No. 08/859,600 filed May 20, 1997, now abandoned.

BACKGROUND OF THE INVENTION

1. Field of the Invention

The present invention deals with snow guards used to prevent excessive amounts of snow and ice from falling off sloped roofs and injuring people or destroying property.

2. Description of the Related Art

Previous attempts by prior art at solving the problem of excessive amounts of snow and ice falling off roofs have failed for a variety of reasons. Some prior devices have used an inadequate way of fastening the snow catching device or "head" to the roof. Prior fabrications for the fastening device which will be referred to as the "strap" have produced devices which bend easily under the pressure of sliding ice and snow. U.S. Pat. No. 1,732,936 to Hudson and U.S. Pat. Nos. 3,296,750 and 5,343,659 to Zaleski employ the use of thin metal strips which are not sufficiently resistant to bending resulting in the head being disrupted from its proper position on the roof. When these straps fail, they usually do extensive damage to the roofing material they are installed beneath and fail to hold back snow and ice. U.S. Pat. No. 5,044,130 to Chiddister omits a strap entirely. The head is held by fasteners which penetrate the face of the roofing material. The disadvantage of this method is that creating holes in the roofing material gives a potential for leaks. Over time, water may seep into these holes, rotting away the roof.

Another area where prior art forms have failed is the means by which the head is fastened to the strap. Bolts and rivets have failed by deforming and shearing off under heavy loads. Many prior devices fail to provide adequate rigidity in the connection area between the head and the strap. This problem results in the head either shearing off or bending under the weight of the snow and ice slides.

The third area of prior art failure is the shape of the head. Many heads have a flat face which comes into contact with the sliding snow and ice. A flat abrupt face is ideal for catching snow and ice but results in tremendous loads being placed on the snow guard and does little to break up sheets of ice. These loads cause the failures already mentioned and require the heads to be made from thick material or cast from molten material which increases costs. A flat face head requires a rigid connection between itself and the strap, thereby complicating fastening details and increasing costs. Field observations of prior devices have shown failures in this area. Breaking up sheets of ice that slide down roofs has two benefits: first, smaller pieces of ice melt faster and second, the smaller pieces of ice are less likely to do damage if they fall from the roof. Flat face heads do very little to break up sheets of ice.

BRIEF SUMMARY OF THE INVENTION

The present invention is a snow guard for securing to a roof to prevent snow from falling from the roof in large chunks. The snow guard includes a strap and a head rigidly attached to the strap. The strap has two horizontal plies. The horizontal plies are connected to each other along their full lengths by their longitudinal edges. The connection of the horizontal plies and the attachment of the head to the strap are such that they are sufficiently strong to prevent the head from bending with respect to the strap.

Each of the strap and the head may be made of corrosion resistant material. The strap may be made from a flattened tube. The head may be welded or soldered to the strap. The strap may also include a top end and a bottom end and the top end may include a hook. The head may be made of one ply of a corrosion resistant material. The head may have a pointed face or a curved face. The head is made of a unitary piece of material.

Figure 1:
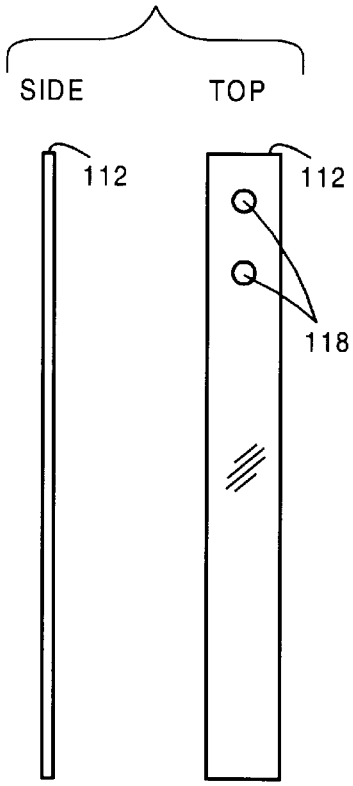
FIG. 1 shows a strap in accordance with the present invention for use with new roofs where screws or nails are placed through the holes to hold the strap to the roof deck.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE INVENTION

Figure 7:
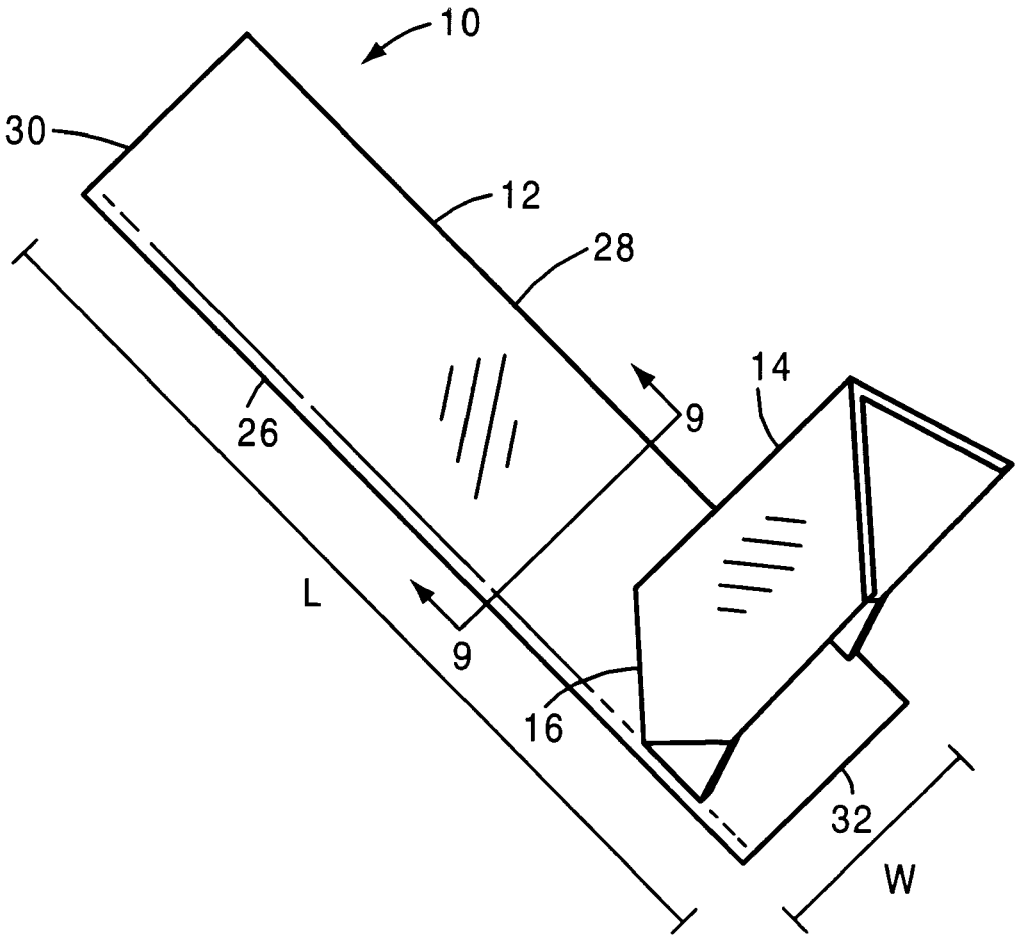
FIG. 7 is a perspective view of a snow guard in accordance with the present invention.

The snow guard 10 is best shown in FIG. 7. The snow guard 10 includes a strap 12 and a head 14. The head 14 is rigidly attached to the strap 12 at a joint 16. There are a variety of configurations of both the strap 12 and the head 14. These are shown in greater detail in the remaining Figs.

Figure 2:
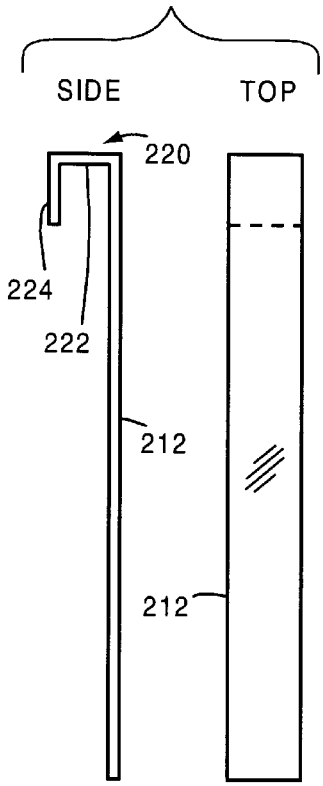
FIG. 2 shows a strap in accordance with the present invention for use with tile roofs.
Figure 3:
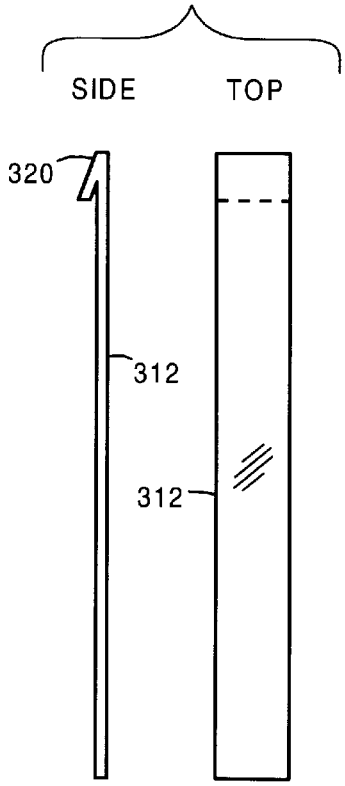
FIG. 3 shows a strap in accordance with the present invention for use with existing shingle or slate roofs.

Turning to FIGS. 1–3, the preferred configurations of the strap are shown. Strap 112 as shown in FIG. 1 is designed primarily for use with a new roof. The strap 112 includes two holes 118. Screws, nails, or other attachment mechanisms can be inserted through the holes 118 and into a roof (not shown) for securing the strap 112 to a roof. This type of strap is used on new slate or shingle roofs where the snow guards are installed at the same time the roofing is. The holes 118 and accompanying nails or screws in the strap 112 do not create a leakage problem as mentioned in connection with other devices because they are installed under the next layer or course of roofing and are hidden and protected from the elements. This type of strap 112 should not be used with pre-existing roofs as leakage may occur when holes are made in the roof when installing the snow guard.

The strap 212, as shown in FIG. 2, includes a hook 220. The hook 220 includes a horizontal section 222 and a vertical section 224. This strap 212 is used most preferably with existing roofs made of tile. The tile requires a certain level of horizontal clearance before the hook may be inserted behind the existing tiles. This requires that the horizontal section 222 of the hook 220 be sufficiently deep that it will encompass the width of the tile.

FIG. 3 shows yet another embodiment of a strap 312 for use with existing slate or shingle roofs. This strap 312 includes a hook 320 which is merely a bent portion. This hook 320 need not be as complex as the hook 220 on the strap 212, as slate and shingle roofs do not require as much clearance in order to attach the strap 312 to the roof.

Figure 9:
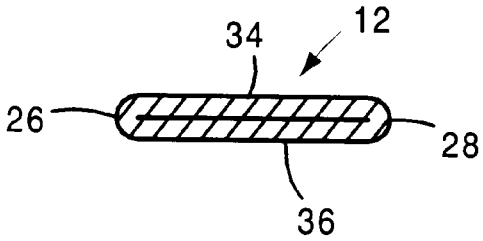
FIG. 9 is a cross-sectional view of a strap in accordance with the present invention taken along line 9—9 of FIG. 7.

The construction of the basic characteristics of the strap 12 is best shown in FIGS. 7 and 9. The strap 12 includes two longitudinal edges 26, 28, a top end 30, and a bottom end 32. If any holes 118 are to be included, they should be placed near the top end 30. If any hooks 220, 320 are to be included, they should be included as a part of the top end 30. The head 14 should be secured or attached to the strap 12 closer to the bottom end 32. The strap 12 is preferably made from a flattened tube as is best shown in FIG. 9. The use of a flattened tube provides a strap which is more resistant to bending than if a strap which were made of a solid material of the same overall thickness were used. This is of a great advantage because the strap thickness is limited by the roofing material under which it is installed. Too thick a strap will cause a shingle or tile on a roof to be raised in an unattractive manner and cause leakage. When the tube is pressed or flattened it creates a strap having two horizontal plies 34, 36 which are connected to each other along their full lengths L by their longitudinal edges 26, 28. This configuration is more resistant to bending than if a solid material of the same overall thickness were used and more resistant to bending than two plies which are not joined the full lengths of their longitudinal edges. Because of the desired configuration of the strap 12, it is preferred that the strap be formed of a corrosion-resistant, non-ferrous metal. The strap also has a sufficient width W to provide for a rigid connection between the strap 12 and the head 14. The head and the strap are preferably soldered or welded to each other. The soldering or welding of the head 14 to the strap 12 transfers loads from the head and prevents the head from bending and defeating the purpose of the invention.

Figure 4:
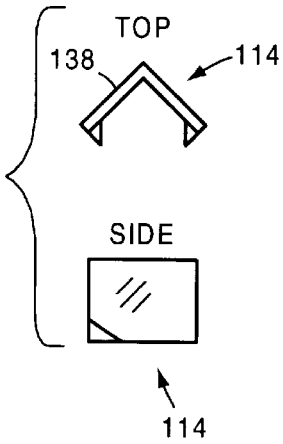
FIG. 4 shows a head having a pointed face.
Figure 5:
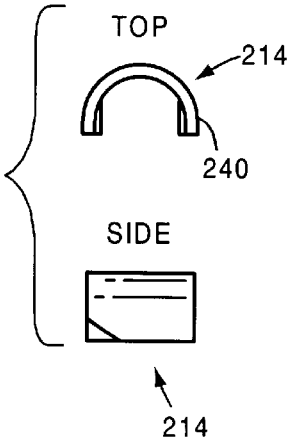
FIG. 5 shows a head having a curved face.
Figure 6:
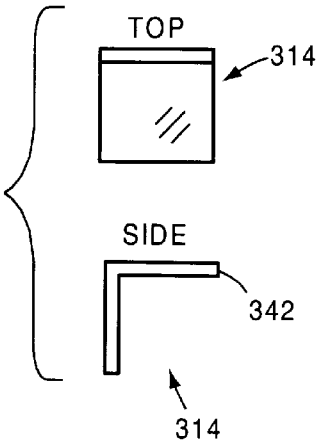
FIG. 6 shows a head having a flat face.

The various designs for the head are shown in FIGS. 4–6. The head 114 in FIG. 4 includes a pointed face 138. The head 214 in FIG. 5 includes a curved face 240. The head 314 in FIG. 6 includes a flat face 342. Each of the heads 114, 214, 314 is made of a single piece of material. The head is preferably made from a single ply of non-ferrous, corrosion resistant metal in sheet form. Preferably square pieces of the material are pressed into dies to form the various shapes. The head 314 which includes the flat face 342 must be substantially thicker than the heads 114, 214 with the pointed face 138 and curved face 240 respectively, because the head 314 with the flat face does not transfer or resist loads as well as the other shapes.

The head 14 serves to stop or break up snow and ice. The heads 114, 214 which include a pointed face 138 or a curved face 240 are designed to separate and slow sheets of snow and ice which slide down the roofs. The pointed face 138 or curved face 240 will breakup snow and ice much in the same way the bow of a ship breaks up ice on a frozen lake. The pointed face 138 or rounded face 240 configurations are rigid structures able to withstand heavy loads during severe snow and ice conditions. The head 314 having the flat face 342 is for applications where the maximum amount of snow is to be retained on the roof and the loads placed on the snow guard from snow fall are not as great.

Figure 8:
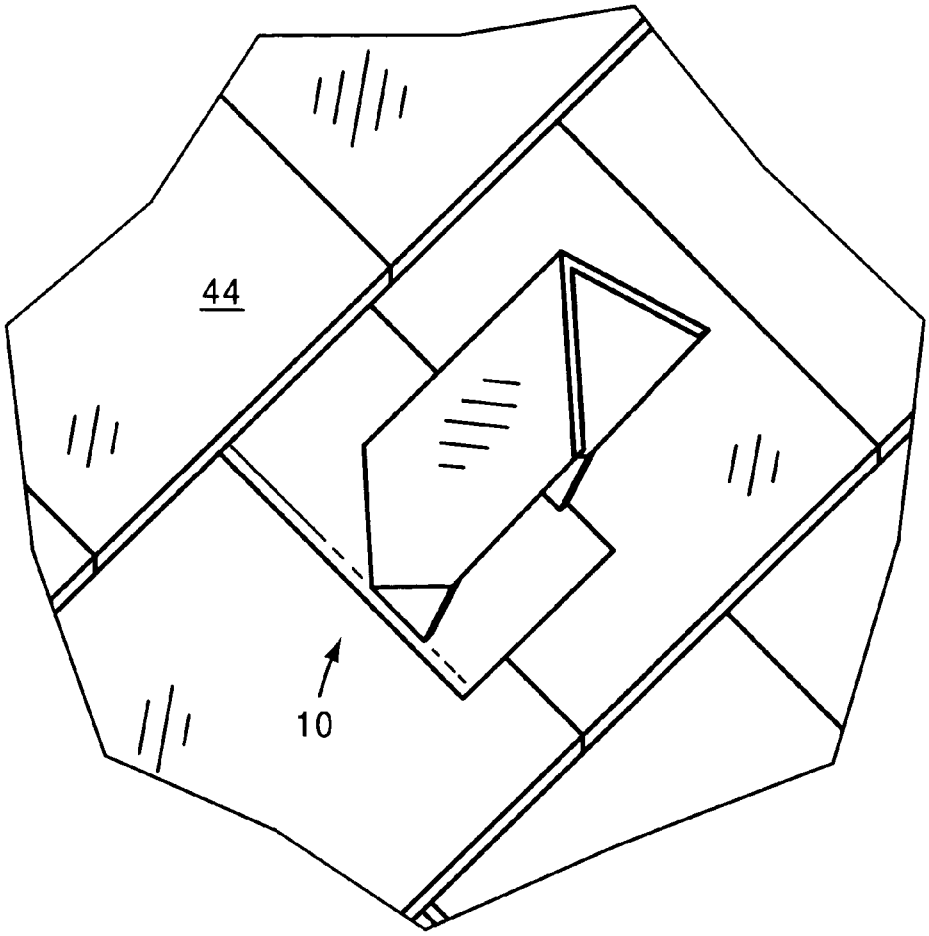
FIG. 8 is a perspective view of a snow guard in accordance with the present invention installed on a roof.

Turning now to FIG. 8, this fig. shows the placement of the roof guard 10 with respect to a roof 44. The snow guard 10 is placed on the roof 44 in the conventional way as disclosed in previous patents.

While certain preferred embodiments of the present invention have been disclosed in detail, it is to be understood that various modifications may be adopted without departing from the spirit of the invention or scope of the following claims.

I claim:

1. snow guard for securing to a roof to prevent snow from falling from said roof, comprising:

a strap, said strap being a flattened tube having two horizontal plies, said horizontal plies being integrally joined to each other along a full length of their longitudinal edges; and a head rigidly attached to said strap and projecting away from one of said horizontal plies of said strap a height sufficient to interfere with the free movement of snow and ice past said head, said connection of said horizontal plies and said attachment of said head to said strap being of sufficient strength to prevent said head from bending with respect to said strap.

2. The snow guard according to claim 1, wherein said strap is made of corrosion-resistant material.

3. The snow guard according to claim 2, wherein said head is made of corrosion-resistant material.

4. The snow guard according to claim 1, wherein said head is made of corrosion-resistant material.

5. The snow guard according to claim 1, wherein said head is welded to said strap.

6. The snow guard according to claim 1, wherein said head is soldered to said strap.

7. The snow guard according to claim 1, wherein said strap includes a top end and a bottom end, said top end including a hook.

8. The snow guard according to claim 1, wherein said head is made of one ply of a corrosion resistant material.

9. The snow guard according to claim 1, wherein said head has a pointed face.

10. The snow guard according to claim 1, wherein said head has a curved face.

11. The snow guard according to claim 1, wherein said head is a unitary piece of material.

12. The snow guard according to claim 11, wherein said strap is made of corrosion-resistant material.

13. The snow guard according to claim 11, wherein said head is made of corrosion-resistant material.

14. The snow guard according to claim 11, wherein said head is made of corrosion-resistant material.

15. The snow guard according to claim 11, wherein said strap is a flattened tube.

16. The snow guard according to claim 11, wherein said head is welded to said strap.

17. The snow guard according to claim 11; wherein said head is soldered to said strap.

18. The snow guard according to claim 11, wherein said strap includes a top end and a bottom end, said top end including a hook.

19. The snow guard according to claim 11, wherein said head is made of one ply of a corrosion resistant material.

* * * * *

UNITED STATES PATENT AND TRADEMARK OFFICE

CERTIFICATE OF CORRECTION

PATENT NO. : 5,943,826

DATED : Aug. 31, 1999

INVENTOR(S) : Totin

It is certified that error appears in the above-indentified patent and that said Letters Patent is hereby corrected as shown below:

Column 4, line 13, in claim 1 after "1." and before "snow" insert ---A---; line 50, in claim 13 delete "11" and insert therefor ---12---; line 58, in claim 17 delete ";" and insert therfor ---,---.

Signed and Sealed this

Seventh Day of March, 2000

*Attest:*

*Attesting Officer*

Q. TODD DICKINSON

*Commissioner of Patents and Trademarks*